United States Patent [19]

Takeda

[11] 4,145,591

[45] Mar. 20, 1979

[54] INDUCTION HEATING APPARATUS WITH LEAKAGE FLUX REDUCING MEANS

[75] Inventor: Tukasa Takeda, Yokohama, Japan

[73] Assignee: Nitto Chemical Industry Co., Ltd., Tokyo, Japan

[21] Appl. No.: 756,256

[22] Filed: Jan. 3, 1977

[30] Foreign Application Priority Data

Jan. 24, 1976 [JP] Japan ..... 51-6150[U]
Jul. 9, 1976 [JP] Japan ..... 51-90558[U]

[51] Int. Cl.[2] ..... H05B 5/08

[52] U.S. Cl. ..... 219/10.49 R; 219/10.51; 219/10.79

[58] Field of Search ..... 219/10.49, 10.51, 10.79

[56] References Cited

U.S. PATENT DOCUMENTS

| | | | |
|---|---|---|---|
| 1,362,622 | 12/1920 | Hendricks | 219/10.51 |
| 2,513,242 | 6/1950 | Inman | 219/10.51 |
| 2,563,883 | 8/1951 | Strickland | 219/10.51 |
| 3,219,786 | 11/1965 | Wenzel | 219/10.49 |
| 3,440,384 | 4/1969 | Schoeder | 219/10.51 |
| 3,520,980 | 7/1970 | Sterling et al. | 219/10.49 |
| 3,843,858 | 10/1974 | Buell | 219/10.51 |

FOREIGN PATENT DOCUMENTS 28906 8/1972 Japan.

*Primary Examiner*—Bruce A. Reynolds
*Attorney, Agent, or Firm*—Blanchard, Flynn, Thiel, Boutell & Tanis

[57] ABSTRACT

An induction heating apparatus, which comprises: a heating element with a hollow, i.e. an interior cavity, for accommodating the material-to-be-heated therein, said heating element being made of metallic material; a ring for generating magnetic flux disposed surrounding said heating element and composed of a ring core and an electric conductive wire wound round said ring core in a coil manner and electrically insulated from the ring core; and an electric conductor disposed outside the heating element as well as the ring for generating magnetic flux and having both ends thereof electrically connected with the two ends of a desired heat generating portion of said heating element, said electric conductor being devised to cover substantially the circumference of said heating element as well as said ring for generating magnetic flux.

12 Claims, 11 Drawing Figures

INDUCTION HEATING APPARATUS WITH LEAKAGE FLUX REDUCING MEANS

BACKGROUND OF THE INVENTION

The present invention relates to an induction heating apparatus which is provided with a hollow heating element for accommodating the material-to-be-heated therein and said heating element per se is to be heated by virtue of the electromagnetic induction generated by using a power source of conventional power-line frequency (mains frequency).

As a typical one of the conventional apparatuses of this kind, there is known an apparatus such as illustrated in the appended FIG. 1 (*a*) and (*b*) which has been invented by the inventor of the present invention as disclosed in Japanese Utility Model No. 1018984. Therefore, explanation of the conventional induction heating apparatus will be made first by reference to this example.

The induction heating apparatus shown in FIG. 1 (*a*) and (*b*) is of a construction such that on the outside of a cylindrical heating element 1 made of a metallic material with electric resistance higher than that of copper is disposed a ring 2 for generating magnetic flux composed of a ring core 3 made of silicon steel plate and an electric conductive wire 4 covered with an insulating material, said wire being wound round said ring core in a coil manner, and said heating element 1 has the two ends of a desired heat generating portion thereof interconnected electrically by means of band-shaped electric conductors 5 made of copper which are disposed outside said ring 2 for generating magnetic flux.

Inasmuch as this apparatus is of such a construction as above, when electric current $i_1$ derived from a power source of power frequency is applied to said electric conductive wire 4 connected with said power source, there is generated a looped magnetic flux $\phi$ along the ring 2 for generating magnetic flux, and whenever this magnetic flux $\phi$ is changed, electric current $i_2$ running along the axial direction is induced in the heating element 1 having both ends thereof short-circuitted by means of the electric conductors 5, whereby the ohmic loss (resistance loss) owing to this electric current $i_2$ flowing in the heating element 1 turns into heat and accordingly the heating element 1 per se is heated. Consequently, when a material-to-be-heated is accommodated in the hollow of the heating element 1, said material-to-be-heated can be heated with the heat of said heating element.

Accordingly, the principle of heating by means of this apparatus is different from the principle of heating by means of apparatuses in the prior art such as illustrated in FIG. 2 (*a*) and (*b*). That is, the frequency converter 33 required for the latter in order to apply a high frequency current $i_1$ to the coil 32 wound round the cylindrical wall member 31 made of a conductive material is not required for the former; in the case of the latter, the magnetic path is substantially within the air thereby requiring an exciting current of relatively large value, while in the case of the former, the magnetic path is closed by a core of a high permeability thereby requiring merely an exciting current of relatively small value and therefore the power-factor thereof is greater than that of the latter; further, in the case of the latter, only the portion of the cylindrical wall member 31 wound round with the coil 32 can be heated, while in the case of the former, uniform heating can be effected over a desired portion of the heating element 1 by merely adjusting the connecting position of the electric conductor 5 on the heating element 1 regardless of the position of the coil. This apparatus of FIG. 1 (*a*) and (*b*) has therefore many advantages compared with apparatuses in the prior art.

However, this apparatus has still drawbacks such as described below.

The induction heating apparatus illustrated in FIG. 1 (*a*) and (*b*) can be regarded as a sort of transformer provided with primary coil and a secondary one-turn coil wherein the electric conductive wire 4 constitutes the primary coil and the closed circuit formed of the heating element 1 and the electric conductor 5 constitutes the secondary coil. This apparatus also involves leakage flux which will cause power-factor deterioration of the apparatus per se and induction troubles on surrounding apparatuses. The leakage flux in this sense is generally known to include a magnetic flux which comes in interlinkage with the primary coil alone but does not come in interlinkage with the secondary coil and a magnetic flux which comes in interlinkage with the secondary coil but does not come in interlinkage with the primary coil. It is considered that the former of these two magnetic fluxes is not substantially present in said apparatus on account of the construction thereof, and accordingly, in the case of this apparatus, as the leakage flux, a magnetic flux $\Phi_1$ which makes a round along the circumference of heating element 1 passing the interspace between the heating element 1 and the electric conductor 5 and a magnetic flux $\Phi_2$ which make a round along the circumference of the respective electric conductors 5 are likely to be induced as illustrated in FIG. 1 (*a*). Consequently, these leakage fluxes $\Phi_1$ and $\Phi_2$ can be regarded as the cause of bringing on the power factor deterioration and induction troubles as stated above.

As the means of reducing the occurrence of these leakage fluxes $\Phi_1$ and $\Phi_2$, it is conceivable to dispose the electric conductor 5 close to the heating element 1 as much as possible thereby minimizing the interspace between the heating element 1 and the electric conductor 5, that is, the "size of window" formed by the two, as far as possible, and actually it has been confirmed by the inventor of this invention that this means is effective. And yet, even when this means is adopted, in the case where the heating element 1 is a large-sized vessel and the output thereof is big, the value of electric resistance possessed by the heating element vessel will become very small and accordingly the value of resistance component on said secondary one-turn coil side will become very small, thereby rendering it indispensable to make the value of reactance component of the secondary one-turn coil side very small in proportion to the smallness of said resistance component. This reactance component is under the direct control of the leakage fluxes $\Phi_1$ and $\Phi_2$ and, nevertheless, the value thereof cannot be minimized to a desired degree even with leakage fluxes $\Phi_1$ and $\Phi_2$ reduced substantially by the foregoing means. Therefore, in the case this apparatus is of the above construction, employment of the foregoing means with respect to the leakage fluxes $\Phi_1$ and $\Phi_2$ falls short of satisfactory countermeasure.

When the leakage flux $\Phi_1$ is compared with the leakage flux $\Phi_2$, since the magnetic path of the former is longer than that of the latter and the sectional area of magnetic path is smaller as it is restricted by the aforesaid "size of window," the magnetic resistance is greater, while as for the leakage flux $\Phi_2$, since the magnetic path thereof is shorter than that of the former and the sectional area of the greater part other than said "window" portion of the magnetic path is very large, the magnetic resistance is smaller. It will therefore be understood that the effect of the leakage flux $\Phi_2$ is greater than that of the leakage flux $\Phi_1$ as the cause of bringing on the aforesaid power factor deterioration and induction troubles of leakage flux.

In addition, in the case of this apparatus, since there appears a potential difference, though it is trifling, in between the two ends of a desired heat generating portion of the heating element 1 and this potential difference has a large current capacity, when this apparatus is connected with an external structure, a leakage current flows to the connected external structure. It will therefore be easily understood that, in the case where this apparatus is employed as, for instance, a reactor in chemical factory dealing with combustible materials, said leakage current flowing to the external structure connected with the heating element 1 of the apparatus through the pipe line or the like is very dangerous from the viewpoint of security and disaster prevention.

SUMMARY OF THE INVENTION

Principal object of the present invention is to provide an induction heating apparatus which eliminates the above discussed drawbacks of the conventional induction heating apparatuses.

Another object of the present invention is to provide an induction heating apparatus which comprises a heating element with a hollow for accommodating the material-to-be-heated therein and an electric conductor disposed outside a ring for generating magnetic flux disposed surrounding said heating element, the magnetic flux generating ring being composed of a ring core and an electric conductive wire wound round said ring core in a coil manner and electrically insulated from the ring core, said electric conductor having both ends thereof electrically connected with the two ends of a desired heat generating portion of said heating element and being so formed as to substantially cover the circumference of said heating element as well as said ring for generating magnetic flux, thereby rendering it possible to enhance the power-factor of the apparatus per se up to substantially the maximum degree and also making the apparatus free from causing induction troubles on surrounding apparatuses.

A further object of the present invention is to provide an induction heating apparatus which is of construction, such that, upon forming said electric conductor in the above fashion, a cylindrical member made of ferromagnetic material is disposed outside the electric conductor so as to cover said heating element, ring for generating magnetic flux and electric conductor, and both ends of said cylindrical member are electrically connected with the two ends of a desired heat generating portion of the heating element or both ends of the electric conductor, whereby occurrence of said leakage flux is prevented on one hand thereby making the apparatus free from hazardous conditions even when a combustible material is dealt with therein and occurrence of leakage current flowing to other external structures is prevented on the other hand thereby making the apparatus free from impediment to the improvement of power-factor of the apparatus per se or causing induction troubles thereon.

A still further object of the present invention is to provide an induction heating apparatus which is of construction, such that, said electric conductor is composed of an inner conductor which substantially covers the circumference of said heating element and said ring for generating magnetic flux and an outer conductor which is disposed outside this inner conductor and provided with a ring core interposed in between said outer and inner conductors, whereby the thickness of said cylindrical member made of ferromagnetic material can be thinned off while maintaining the efficiency of apparatus with respect to the prevention of occurrence of said leakage current, thereby reducing the weight of apparatus as a whole and facilitating the installation thereof.

BRIEF DESCRIPTION OF THE DRAWING

In the appended drawings:

FIG. 1 (*b*) is a diagram illustrative of the principle of heating in the case of the apparatus shown in FIG. 1 (*a*);

FIG. 2 (*b*) is a diagram illustrative of the principle of heating in the case of the apparatus shown in FIG. 2 (*a*);

DETAILED DESCRIPTION OF THE INVENTION

Figure 3:
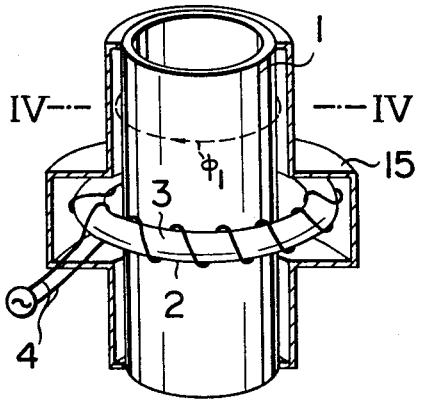
FIG. 3 is a diagrammatic representation of a first embodiment of the induction heating apparatus according to the present invention.
Figure 4:
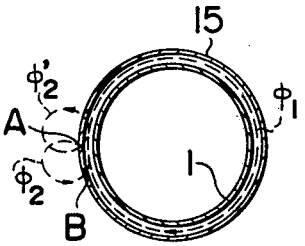
FIG. 4 is a cross-sectional view taken along the line IV—IV in FIG. 3.

In FIGS. 3 and 4 illustrative of a first embodiment of the induction heating apparatus according to the present invention, the parts functionally identical with that of the conventional apparatus shown in FIG. 1 (*a*) are indicated by the same reference numerals as in FIG. 1(*a*) thereby to dispense with repetition of detailed explanation as far as possible, and mainly the points of difference will be explained in the following.

Figure 1A:
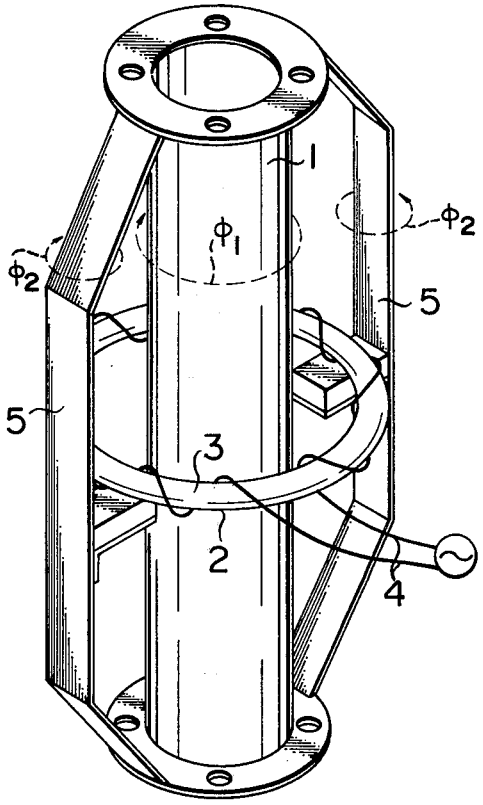
FIG. 1a PRIOR ART
FIG. 1 (*a*) is a diagrammatic representation of an example of the conventional induction heating apparatus.
Figure 1B:
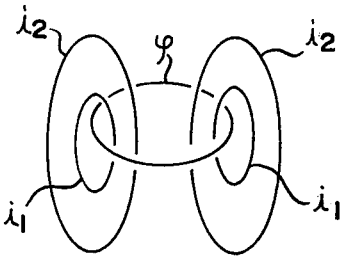
FIG. 1b PRIOR ART
Figure 2A:
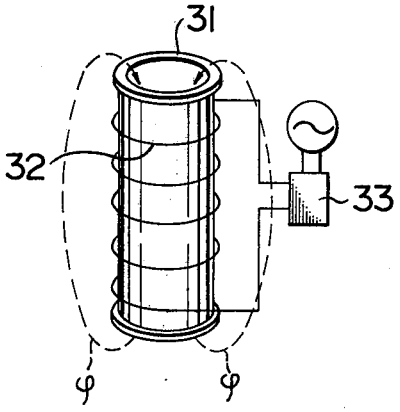
FIG. 2a PRIOR ART
FIG. 2 (*a*) is a diagrammatic representation of another example of the conventional induction heating apparatus.
Figure 2B:
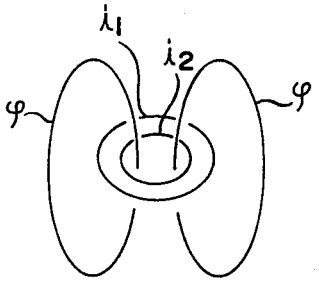
FIG. 2b PRIOR ART

The conspicuous difference between the apparatus embodying the present invention illustrated in FIGS. 3 and 4 and the apparatus illustrated in FIG. 1 (*a*) lies in that the electric conductor 15 of the former is not of band-shaped, but is devised to substantially cover the circumference of the heating element 1 and the ring for generating magnetic flux 2.

This embodiment is utterly free from the occurrence of leakage flux $\Phi_2$, which would cause power factor deterioration and induction troubles of the aforesaid leakage fluxes $\Phi_1$ and $\Phi_2$, for the reasons described later, and accordingly, there is substantially no leakage of magnetic flux to the outside. Assuming that there is a magnetic flux $\Phi_2$ which leaks from point A of the electric conductor 15 in FIG. 4 to the outside and returns to the inside from point B, inasmuch as the diagram of FIG. 4 is a symmetrical figure centering around the central point thereof, there should be present flux $\Phi_2'$ identical with flux $\Phi_2$ in both intensity and direction as illustrated therein. However, fluxes $\Phi_2$ and $\Phi_2'$ at point A are equal in intensity and opposite to each other in direction, and therefore, co-existance of both fluxes is impossible. Accordingly, presence of flux $\Phi_2$ is also impossible. Consequently, the electric conductor 15, though it does not have properties as an insulating shield against magnetic flux, functions to intercept the occurrence of leakage flux and substantially prevent the leak of flux to the outside.

In this connection, there is admittedly left magnetic flux $\Phi_1$ which makes a round of the circumference of the heating element 1 in the inside of the electric conductor 15, but the power factor deterioration and induction trouble caused by flux $\Phi 1$ is so slight that it is substantially negligible. In addition, inasmuch as this magnetic flux $\Phi 1$ can be easily computed at high precision in case the designer does not want to ignore and takes it into consideration at the time of actually designing an induction heating apparatus, it will pose no problem in designing.

Therefore, the induction heating apparatus illustrated in FIGS. 3 and 4 has the advantage that the power-factor of the apparatus per se can be enhanced to a very high rate and the apparatus is free from causing induction troubles, attributable to leakage flux on the surrounding apparatuses.

This apparatus has also the advantage that, inasmuch as the potential difference viewed from the external structures appears only as a very small potential difference depending on the degree of fall of potential within the electric conductor 15 in between the two ends of a desired heat generating portion of the heating element 1, there is no fear of causing such accidents as electric shock on human body.

The foregoing electric conductor 15 is made of an electric conductive material such as copper or the like, and it is most desirable to form it in a cylindrical shape capable of accomodating the heat element 1 and the ring 2 for generating magnetic flux 2 in the inside thereof.

Figure 5:
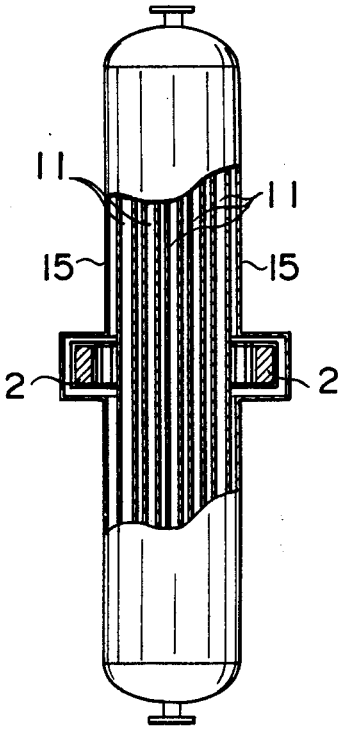
FIG. 5 is a longitudinal sectional view of an actual apparatus manufactured on the basis of the embodiment illustrated in FIG. 3.
Figure 6:
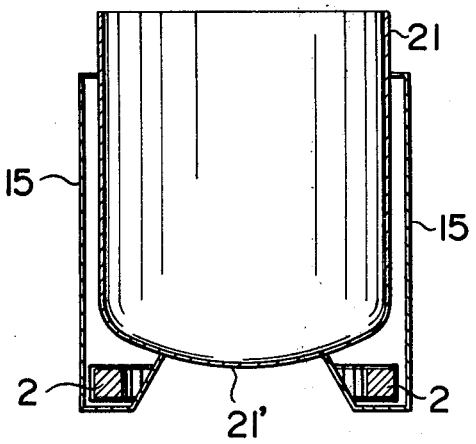
FIG. 6 is a longitudinal sectional view of another actual apparatus manufactured on the basis of the embodiment illustrated in FIG. 3.

The shape of the heating element 1 is not limited to the cylindrical shape. The heating element 1 may be composed of a bundle of plural number of heating tubes 11, each tube being devised to let the material-to-be-heated pass therethrough, as illustrated in FIG. 5. It also will do to construct the heating element 1 in the form of a vessel 21 having the bottom wall 21' such as illustrated in FIG. 6; in this case, the ring 2 for generating magnetic flux can be disposed near the circumference of the bottom wall 21' of said vessel 21 as shown in the drawing, and it will of course do to fit said ring 2 around the outside of the central part of the vessel 21.

The heating element 1 can be made of at least one kind of metallic material selected from iron, carbon steel, stainless steel, heat resisting steel, etc. whose electric resistance is greater than that of copper.

The ring core 3 can be one formed by rolling up a continuous carbon steel band in a ring shape or one formed by assembling reactangular carbon steel plates in a core type ring or one formed by piling up ring-shaped carbon steel plates. As the material for the ring core 3, in lieu of carbon steel plate, mild steel plate can be used as well.

Next, with reference to FIGS. 7 through 9, two other embodments of the present invention will be explained in the following. In this context, as the substance of the descriptions of the first embodiment applies to these two embodiments, for the sake of simplifying the explanation as far as possible, the parts functionally identical with that of the first embodiment are indicated by the same reference numerals as used in the latter apparatus, and mainly the points of difference will be explained.

Figure 7:
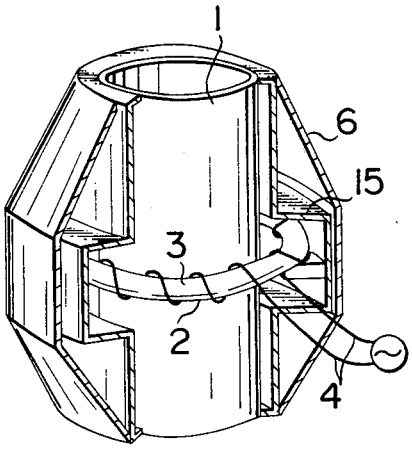
FIG. 7 is a diagrammatic representation of a second embodiment of the induction heating apparatus according to the present invention.

The induction heating apparatus of a second embodiment of the present invention illustrated in FIG. 7 is of a construction such that a cylindrical member 6 made of ferromagnetic material is disposed outside the apparatus of the first embodiment to cover the circumference thereof and both ends of said cylindrical member 6 are electrically connected with the two ends of a desired heat generating portion of the heating element 1 or the two ends of the electric conductor 15 respectively.

This apparatus is substantially free of the flow of leakage current to the external structure connected therewith for the reason as described below. When AC voltage is applied to the electric conductive wire 4 of this apparatus, a very small potential difference like in the case of the apparatus of the first embodiment appears in between the exterior of the electric conductor 15 and the interior of the cylindrical member 6 between the two ends of a desired heat generating portion of the heating element 1. This potential difference can be regarded as an AC power source impressed in between the two ends of the cylindrical member 6 per se from the interior thereof. It is a generally known phenomenon that, in the case where a high-frequency current flows to an electric conductor, said high-frequency current tends to flow centering on the surface and neighborhood of the power source side relative to the electric conductor by virtue of the skin effect, and it is also well known that, in the case where said electric conductor is made of a ferromagnetic material, a considerable skin effect can be obtained from not only electric current of high frequency but also electric current of power frequency. For this reason, the flow of AC current in the cylindrical member 6 which arises from said potential difference centers on the interior of cylindrical member 6 and its vicinity, and it scarcely flows in the exterior of cylindrical member 6 and its vincinity. Accordingly, the value of potential difference viewed from the exterior of the cylindrical member 6 is smaller than the aforesaid small potential difference by several figures, that is, substantially zero. Therefore, when this apparatus is actuated in the state of being connected with an external structure having a very little electric resistance through pipe line, etc. or directly, there occurs substantially no flowing of leakage current to said external structure.

Figure 8:
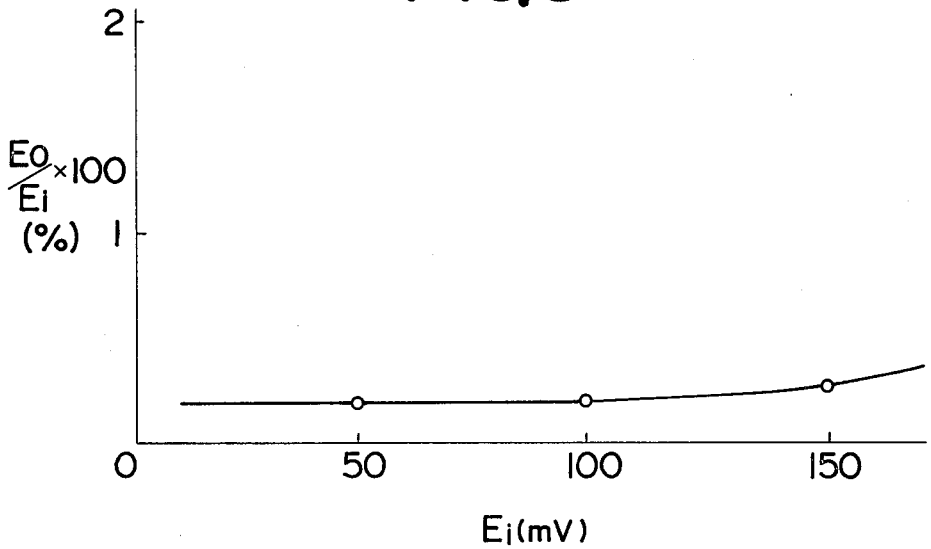
FIG. 8 is a graph representing the result of tests conducted by using the apparatus shown in FIG. 7.

When various values of AC voltage Ei of 50 Hz were applied to the interior of 10B steel tube having a thickness of 5 mm and a length of 1000 mm employed as the cylindrical member 6, the voltage Eo appearing on the exterior of the steel tube was measured, and the relation between the applied voltage Ei and the ratio of residual voltage Eo/Ei was sought, the result was as shown in FIG. 8. As is evident from FIG. 8, the voltage appearing on the exterior of said steel tube was no more than about 0.2% of the applied voltage Ei.

Accordingly, in the case where this apparatus is applied as, for instance, the reactor in a chemical factory dealing with combustible material, inasmuch as no leakage current flows to the external structures, there is no danger from the viewpoint of security and prevention of accidents.

Figure 9:
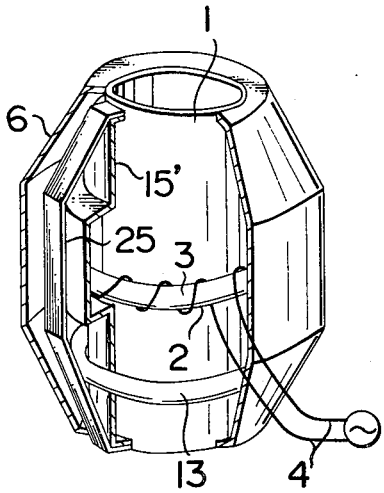
FIG. 9 is a diagrammatic representation of a third embodiment of the induction heating apparatus according to the present invention.

The induction heating apparatus of a third embodiment of the present invention illustrated in FIG. 9 is a modification of the apparatus of the second embodiment, which features in that the electric conductor 15 is replaced with an electric conductor composed of an inner conductor 15' substantially covering the circumference of the heating element 1 and the ring 2 for generating magnetic flux and an outer conductor 25 disposed outside said inner conductor 15' and provided with a ring core 13, said ring core being interposed in between the inner conductor 15' and outer conductor 25.

In the case of this apparatus, inasmuch as a very small potential difference like in the case of the apparatus of the first embodiment appears in between the exterior of the inner conductor 15' and the interior of the ring core 13, and a further small potential difference compared with this potential difference appears in between the exterior of the outer conductor 25 and the interior of the cylindrical member 6, the AC power source to be impressed on the cylindrical member 6 per se in between the two ends thereof from inside comes to be extremely small compared with that in the aforesaid second embodiment. Accordingly, the thickness of the cylindrical member 6 can be lessened compared with that in the second embodiment notwithstanding that the thicker is the cylindrical member, the more conspicuous is the skin effect rendering enhancement of said ratio of residual voltage (Eo/Ei). This apparatus has therefore the advantage that it can be of light weight compared with the apparatus of the second embodiment while maintaining the same efficiency as the latter, is economical, and is convenient for installing.

The cylindrical member 6 can be made of a ferromagnetic material selected from malleable iron, electromagnetic wrought iron, carbon steel, cast steel, silicon steel, nickel.chrome steel, nickel.iron alloy, etc.

Although particular preferred embodiments of the invention have been disclosed in detail for illustrative purpose, it will be recognized that variations or modifications of the above disclosed apparatuses, including the arrangement of parts, lie within the scope of the present invention.

What is claimed is:

1. An induction heating apparatus, which comprises:

a hollow heating element for accommodating the material-to-be heated therein, said heating element being made of a metallic material;

a ring for generating magnetic flux disposed surrounding said heating element and composed of a ring core and an electric conductive wire wound round said ring core to form a toroidal coil electrically insulated from the ring core;

a nonferrous, highly electrically conductive, copperlike shell disposed outside the heating element and magnetic flux generating ring and having the ends thereof electrically connected with the two ends of a desired heat generating portion of the heating element, wherein said copperlike shell substantially covers the circumference of said heating element and magnetic flux generating ring, said copperlike shell being formed in a cylindrical shape capable of accommodating said heating element and magnetic flux generating ring therein; and a cylindrical member made of ferromagnetic material, said cylindrical member being disposed outside said heating element, magnetic flux generating ring and copperlike shell so as to cover them and having the ends thereof electrically connected with at least one of (1) said two ends of said desired heat generating portion of said heating element and (2) the ends of said copperlike shell.

2. An induction heating apparatus according to claim 1, wherein said heating element is composed of a bundle of plural number of tubular heating members.

3. An induction heating apparatus according to claim 1, wherein said heating element is constructed in the form of a vessel having a bottom wall, and said ring for generating magnetic flux is disposed near the circumference of the bottom wall of said vessel.

4. An induction heating apparatus according to claim 1 and 11, wherein said heating element is made of at least one metallic material selected from iron, carbon steel, stainless steel and heat resisting steel whose electric resistance is greater than that of copper.

5. An induction heating apparatus according to claim 1, wherein said ring core is made of silicon steel plate or mild steel plate.

6. An induction heating apparatus according to claim 1, wherein said cylindrical member is made of one ferromagnetic material selected from malleable iron, electromagnetic wrought iron, carbon steel, cast steel, silicon steel, nickel.chrome steel and nickel.iron alloy.

7. An induction heating apparatus, which comprises:

a hollow heating element for accommodating the material-to-be heated therein, said heating element being made of a metallic material;

a ring for generating magnetic flux disposed surrounding said heating element and composed of a ring core and an electric conductive wire wound round said ring core to form a toroidal coil electrically insulated from the ring core;

an electric conductor disposed outside the heating element and magnetic flux generating ring and having both ends thereof electrically connected with the two ends of a desired heat generating portion of the heating element respectively, wherein said electric conductor substantially covers the circumference of said heating element and magnetic flux generating ring, said electric conductor being formed in a cylindrical shape capable of accommodating said heating element and magnetic flux generating ring therein; and a cylindrical member made of ferromagnetic material, said cylindrical member being disposed outside said heating element, magnetic flux generating ring and electric conductor so as to cover them and having both ends thereof electrically connected with the two ends of a desired heat generating portion of said heating element or both ends of said electric conductor, respectively, wherein said electric conductor comprises an inner conductor shell which substantially covers the circumference of said heating element as well as said ring for generating magnetic flux and an outer conductor shell which is disposed outside said inner conductor shell and provided with a further ring core, said further ring core being interposed in between the inner conductor shell and the outer conductor shell.

8. An induction heating apparatus according to claim 7, wherein said heating element is composed of a bundle of plural number of tubular heating members.

9. An induction heating apparatus according to claim 7, wherein said heating element is constructed in the form of a vessel having a bottom wall, and said ring for generating magnetic flux is disposed near the circumference of the bottom wall of said vessel.

10. An induction heating apparatus according to claim 7, wherein said heating element is made of at least one metallic material selected from iron, carbon steel, stainless steel and heat resisting steel whose electric resistance is greater than that of copper.

11. An induction heating apparatus according to claim 7, wherein said ring core is made of silicon steel plate or mild steel plate.

12. An induction heating apparatus according to claim 7, wherein said cylindrical member is made of one ferromagnetic material selected from malleable iron, electromagnetic wrought iron, carbon steel, cast steel, silicon steel, nickel.chrome steel and nickel.iron alloy.

* * * * *

UNITED STATES PATENT AND TRADEMARK OFFICE

CERTIFICATE OF CORRECTION

PATENT NO. : 4 145 591

DATED : March 20, 1979

INVENTOR(S) : Tukasa Takeda

It is certified that error appears in the above-identified patent and that said Letters Patent are hereby corrected as shown below:

Column 8, line 18; delete "and 11"

Signed and Sealed this

*Twenty-fifth* Day of *September 1979*

[SEAL]

*Attest:*

*Attesting Officer*

LUTRELLE F. PARKER

*Acting Commissioner of Patents and Trademarks*